US008134092B2

(12) United States Patent
Turner et al.

(10) Patent No.: US 8,134,092 B2
(45) Date of Patent: Mar. 13, 2012

(54) CIRCUIT BREAKER COVER ATTACHMENT

(75) Inventors: Duane Lee Turner, Fairfax, IA (US); Randy William Blake, Vinton, IA (US)

(73) Assignee: Schneider Electric USA, Inc., Palatine, IL (US)

( * ) Notice: Subject to any disclaimer, the term of this patent is extended or adjusted under 35 U.S.C. 154(b) by 258 days.

(21) Appl. No.: 12/644,211

(22) Filed: Dec. 22, 2009

(65) Prior Publication Data

US 2011/0042191 A1 Feb. 24, 2011

Related U.S. Application Data

(60) Provisional application No. 61/235,730, filed on Aug. 21, 2009.

(51) Int. Cl.
*H01H 1/64* (2006.01)

(52) U.S. Cl. ..... 200/293

(58) Field of Classification Search ..... 200/293, 200/50.32–50.4, 17 R, 400, 401, 500, 501, 200/303; 361/93.1; 335/35, 41, 42, 9–10
See application file for complete search history.

(56) References Cited

U.S. PATENT DOCUMENTS

| | | | | |
|---|---|---|---|---|
| 4,047,134 | A | 9/1977 | Maier et al. | |
| 4,090,156 | A | 5/1978 | Gryctko | |
| 4,114,122 | A | 9/1978 | Grenier | |
| 4,342,974 | A | 8/1982 | Nakano et al. | |
| 4,458,225 | A | 7/1984 | Forsell | |
| 4,639,701 | A | 1/1987 | Shimp | |
| 4,679,018 | A | 7/1987 | McKee et al. | |
| 4,808,953 | A | 2/1989 | Iio et al. | |
| 5,182,532 | A | 1/1993 | Klein | |
| 5,831,500 | A | 11/1998 | Turner et al. | |
| 5,861,784 | A | 1/1999 | Heise et al. | |
| 6,710,688 | B2 | 3/2004 | Wellner et al. | |
| 6,842,096 | B2 | 1/2005 | Ciarcia et al. | |
| 6,980,069 | B2 | 12/2005 | O'Keeffe et al. | |
| 7,130,173 | B2 * | 10/2006 | Barewz | 361/93.1 |
| 7,336,462 | B2 | 2/2008 | Raichle et al. | |
| 7,528,690 | B2 | 5/2009 | Christmann et al. | |
| 7,960,666 | B2 * | 6/2011 | Curnis et al. | 200/400 |
| 2008/0245642 | A1 * | 10/2008 | Curnis et al. | 200/17 R |

* cited by examiner

*Primary Examiner* — Edwin A. Leon

(57) ABSTRACT

A circuit breaker includes a base holding an ampoule assembly, a mechanical cover that fits on the base, and a trim cover which fits on the mechanical cover. The circuit breaker can include cover supports positioned between the ampoule assembly and the base. The cover support includes a coupling member that fits within receiving apertures of the mechanical cover and has a threaded through-channel which aligns with apertures of the trim cover. Screws inserted through the trim cover are received in the through-channel to secure the trim cover, the mechanical cover and the base together. The mechanical cover and the base can have interlocking mechanisms which snap-fit together to further support coupling of the cover and base. The circuit breaker can incorporate a retainer clip which engages an ampoule pin, wherein the clip mounts to the mechanical cover to further support holding of the cover and base together.

17 Claims, 7 Drawing Sheets

CIRCUIT BREAKER COVER ATTACHMENT

RELATED APPLICATION

The present application claims the benefit of priority based on U.S. Provisional Patent Application Ser. No. 61/235,730, filed on Aug. 21, 2009, in the name of inventors Duane Lee Turner and Randy William Blake, entitled "Circuit Breaker Cover Attachment", all commonly owned herewith.

TECHNICAL FIELD

The present disclosure relates generally to electrical distribution equipment and, more particularly, to a circuit breaker cover attachment.

BACKGROUND

A high voltage circuit breaker includes a body which houses internal mechanisms that are subject to loads and forces exerted from interruption gases which originate from within. The circuit breaker includes one or more cover attachments that are mounted to the body and house the internal mechanisms and protect the interruption gases from exiting the breaker. However, if the circuit breaker cover attachments are not sufficiently mounted to the body and thus not adequately supported, the interruption gases may exert a high load to the internal mechanisms as well as the cover attachments and may crack or otherwise damage the circuit breaker.

Thus, a need exists for a low cost reinforcing attachment which supports the cover attachments and prevents pressure from the interruption gases from damaging the cover attachments.

SUMMARY

In an aspect, a circuit breaker is designed to incorporate features which serve to provide additional mechanical support to the circuit breaker and prevent interruption gases from damaging any of the covers and/or base of the circuit breaker. The circuit breaker includes a base holding an ampoule assembly, a mechanical cover that fits on the base, and a trim cover which fits on the mechanical cover. The circuit breaker can include cover supports positioned between the ampoule assembly and the base. The cover support includes a coupling member that fits within receiving apertures of the mechanical cover and has a threaded through-channel which aligns with apertures of the trim cover. Screws inserted through the trim cover are received in the through-channel to secure the trim cover, the mechanical cover and the base together. The mechanical cover and the base can have interlocking mechanisms which snap-fit together to further support coupling of the cover and base. The circuit breaker can incorporate a retainer clip which engages an ampoule pin, wherein the clip mounts to the mechanical cover to further support holding of the cover and base together.

The foregoing and additional aspects of the present disclosure will be apparent to those of ordinary skill in the art in view of the detailed description of various aspects, that are made with reference to the drawings, a brief description of which is provided next.

BRIEF DESCRIPTION OF THE DRAWINGS

The foregoing and other advantages of the present disclosure will become apparent upon reading the following detailed description and upon reference to the drawings.

DETAILED DESCRIPTION

Although the subject matter will be described in connection with certain aspects, it will be understood that the subject matter described herein is not limited to those particular aspects. On the contrary, the inventive subject matter is intended to cover all alternatives, modifications, and equivalent arrangements as may be included within the spirit and scope as defined by the appended claims.

Figure 1:
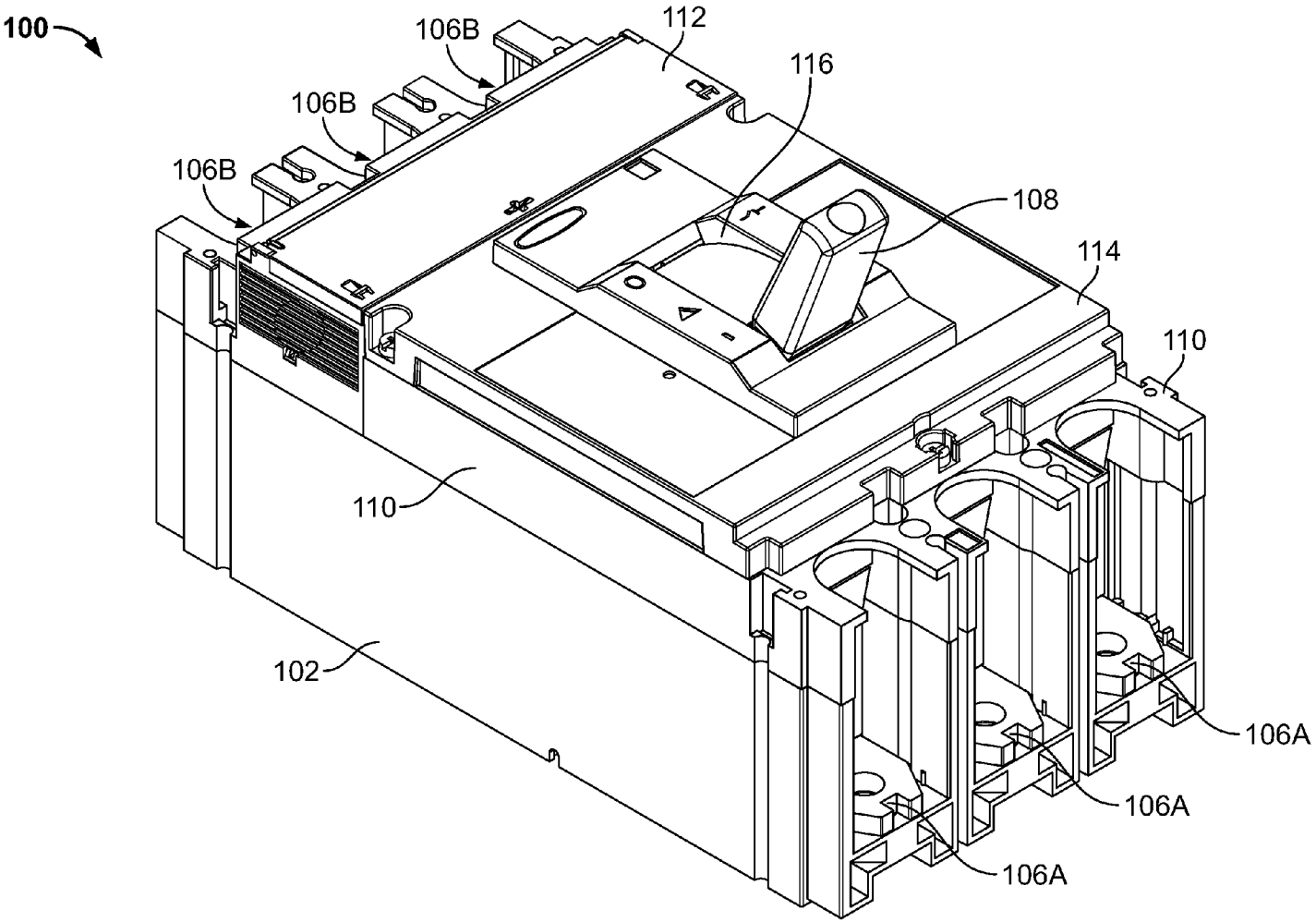
FIG. 1 illustrates a perspective view of a circuit breaker according to one or more aspects of the present disclosure.

Referring to FIG. 1, an electro-mechanical device such as a circuit breaker 100 will be described in general. The circuit breaker 100 generally includes a base 102 having an ampoule assembly therein (see FIG. 2A) in which the ampoule assembly includes one or more line-terminals 106A and one or more load-terminals 106B. The base 102, as shown in FIG. 1, is designed to at least partially house the terminals 106A, 106B along a bottom surface of the circuit breaker 100. A mechanism cover 110 is designed to fit on top of the base 102 along with a trip unit 112 whereby the mechanism cover 110 and trip unit 112 at least partially house the terminals 106A, 106B along a top surface of the circuit breaker 100.

Figure 2A:
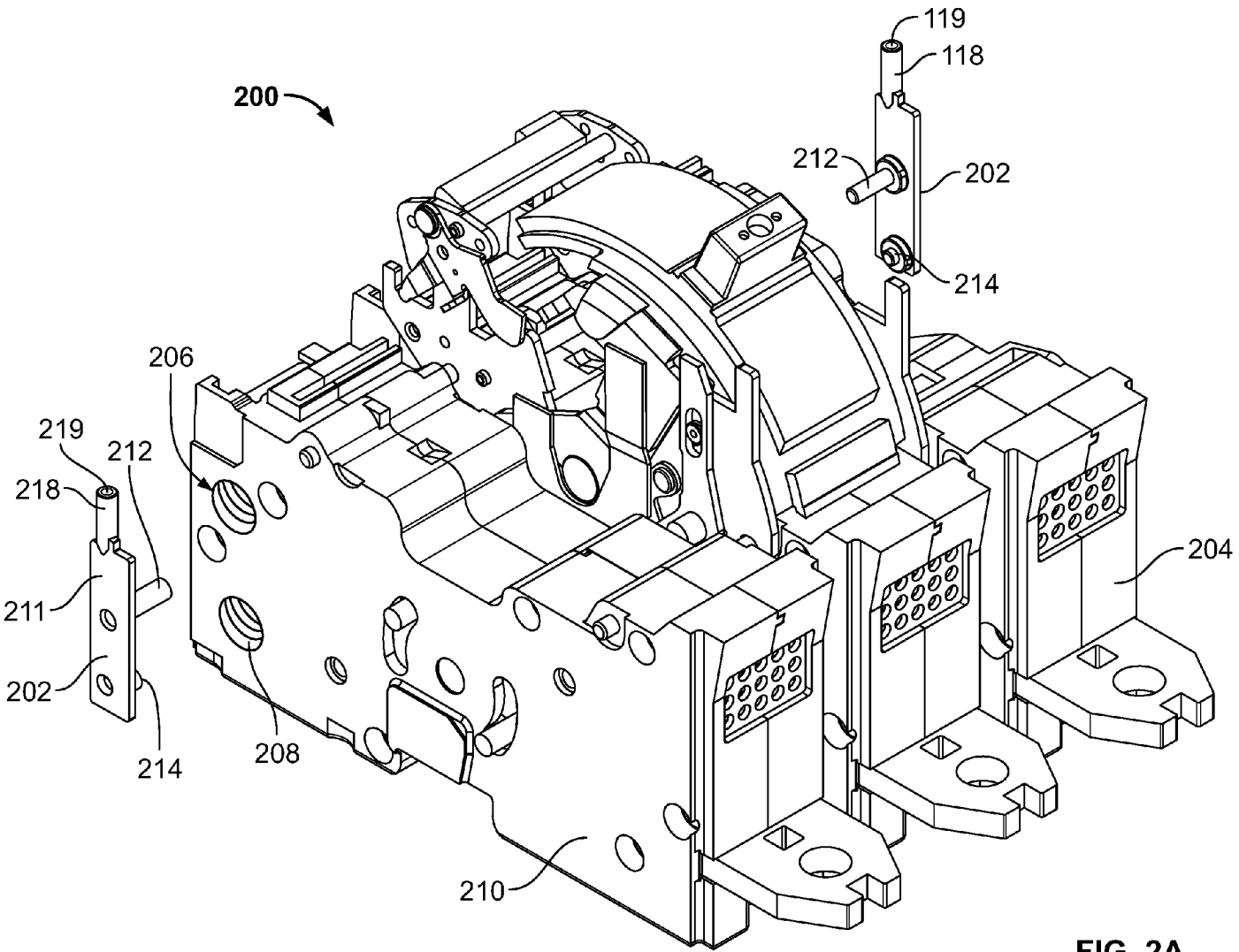
FIG. 2A illustrates an exploded view of an ampoule assembly and cover supports in accordance with one or more aspects of the present disclosure.

As shown in FIG. 1, the handle 108 is coupled to the ampoule assembly (FIG. 2A). A trim cover 114 is designed to fit on top of the mechanism cover 110, in that the handle 108 protrudes through a handle aperture 116 in the trim cover 114. Fastening means, including but not limited to, screws and the like are used to secure the trim cover 114 to the mechanism cover 110.

The handle 108 is to used to manually reset the circuit breaker 100. The handle 108 is also adapted to serve as a visual indication of one of several positions of the circuit breaker 100. When the circuit breaker 100 is in the ON position, current flows unrestricted through the circuit breaker 100 and, therefore, through the electrical device or circuit that the circuit breaker is designed to protect. Another position of the circuit breaker 100 is a TRIPPED position in that the TRIPPED position interrupts the flow of current through the circuit breaker 100 and, consequently, through the electrical device or circuit that the circuit breaker is designed to protect.

Current enters the circuit breaker 100 through a line terminal located near a line-terminal portion 106A and exits the circuit breaker 100 through a load terminal located near a load-terminal portion 106B. A switching mechanism (not shown) within the circuit breaker 100 is activated when the current through the circuit breaker 100 exceeds the rated current by a predetermined threshold over a specified period of time. The switching mechanism causes the handle 108 to move from the ON position to the TRIPPED position, thereby cutting off flow of current through the circuit breaker.

As stated, during the actuation of the circuit breaker 100 from the ON position to the TRIPPED position, interruption gases become present within the circuit breaker 100. The gases attempt to exit the circuit breaker 100 from within, and considering that the pressure from the interruption gases is substantial, the base 102, the mechanism cover 110 and the trim cover 116 must be sufficiently supported and mounted to one another to prevent the gases from damaging them as well as the circuit breaker. Additionally, the base 102, the mechanism cover 110 and the trim cover 116 must be sufficiently supported and mounted to one another to prevent the gases from escaping from within the circuit breaker 100.

FIG. 2A illustrates an exploded view of a portion of a circuit breaker in accordance with an aspect of the present disclosure. As shown in FIG. 2A, the circuit breaker 200 includes a pair of cover supports 202 in that the cover supports 202 are designed to couple to the ampoule assembly 204. In particular to the example shown in FIGS. 2A and 2C, the cover support 202 includes a generally thin, rectangular shaped cover support body 211 with protrusions 212, 214 extending out perpendicularly from the body 211 and a long axis of the through channel. In addition, the cover support 202 includes a cylindrically shaped coupling member 218 which extends from the body 211 in a direction perpendicular to the protrusions 212, 214. The coupling member 218 is desirably hollow within and includes a through-channel 219 oriented along a long axis A that allows a securing screw 99 or other fastening means (FIG. 2B) to be inserted therein. It is contemplated that the interior of the through-channel 219 is already threaded to receive the screw. Alternatively, the interior of the through-channel 219 can be threaded by the securing screw. It is desired that the cover support 202 can include a vertically oriented stabilizing protrusion 221 (FIG. 2C) or similar feature which correspondingly fits within a mating feature (not shown) in the mechanical cover 224 in that the protrusion 221 fits within a corresponding notch in the mechanism cover 224 or the ampoule assembly 204 to reduce twisting of the cover support 202 while the screw 99 is tightened (see below).

The ampoule assembly 204 include apertures 206 and 208 located on the side surface 210, wherein the coupling protrusions 212 and 214 of the cover support 202 correspondingly fit within the apertures 206 and 208. The cover supports 202 can be permanently secured to the ampoule assembly 204 by adhesive, mechanical fasteners (e.g. screws) and the like, although it is not necessary.

Figure 2B:
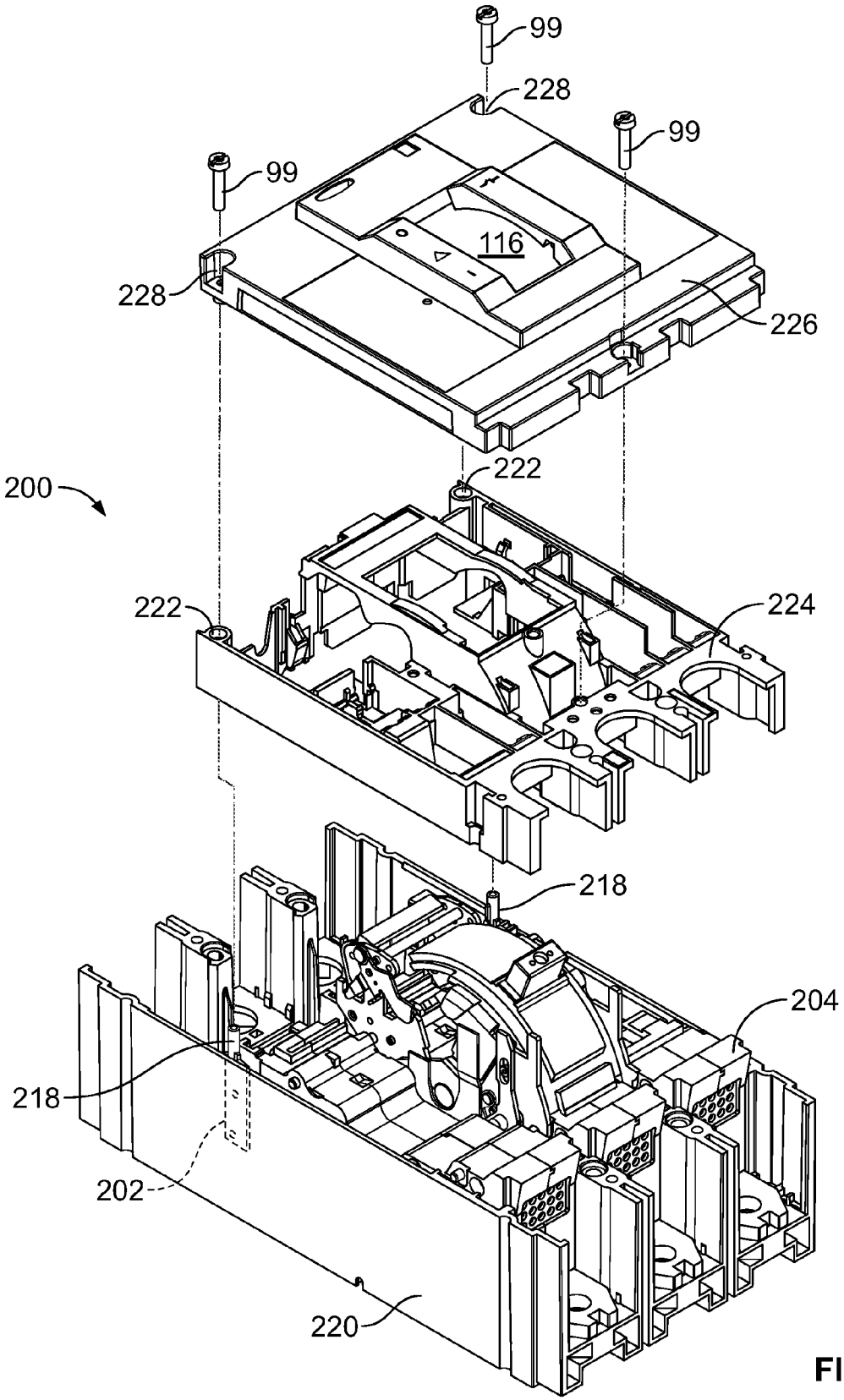
FIG. 2B illustrates an exploded view of a portion of a circuit breaker with cover support in accordance with one or more aspects of the present disclosure.
Figure 2C:
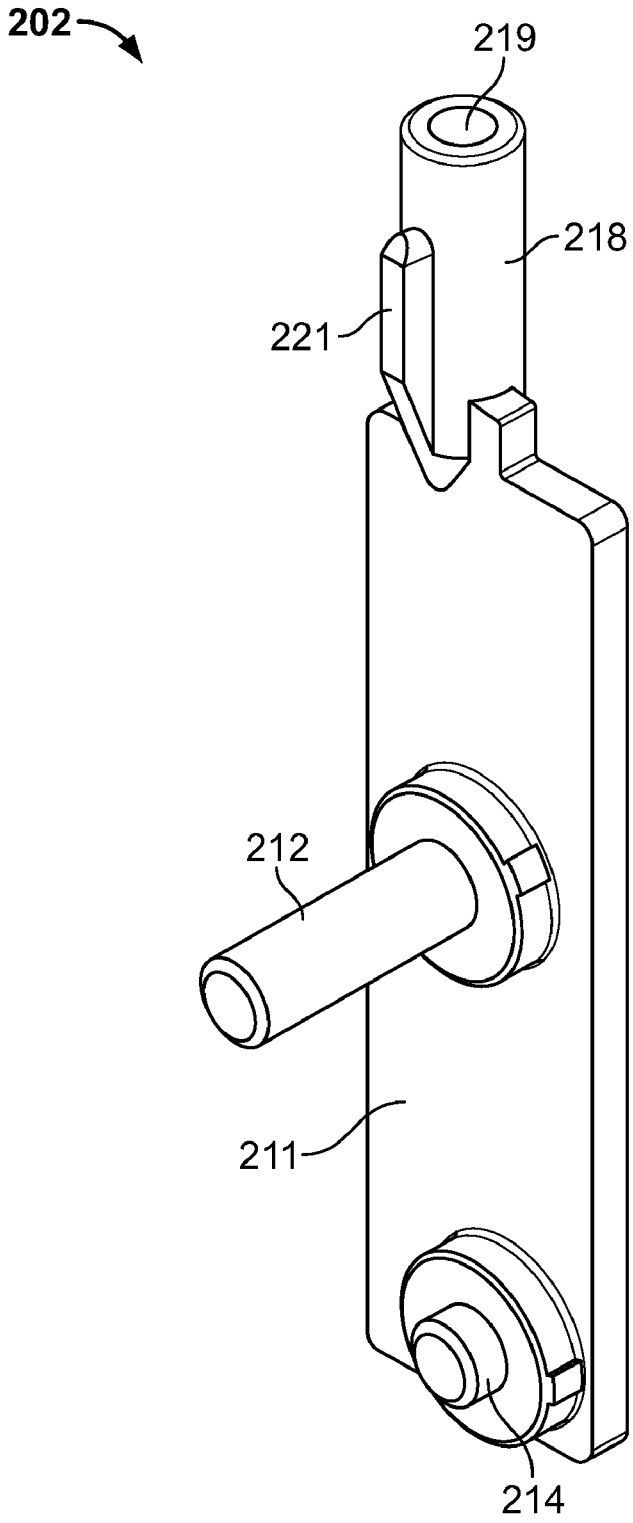
FIG. 2C illustrates a perspective view of the cover support according to one or more aspects of the present disclosure.

The cover support 202 is designed such that the cover support body 211 is flush with the side surface 210 and held secured to the ampoule assembly 204 by the base 220, as shown in FIG. 2B. Additionally, the coupling member 218 of the cover support 202 extends vertically above the base 220 and is positioned to fit within a receiving aperture 222 of mechanical cover 224. It is desired that the cross-sectional dimension of the coupling member 218 is smaller than the cross sectional dimension of the receiving aperture 222 such that the coupling member 218 is able to fit within the receiving aperture 222 when the mechanical cover 224 is placed on top of the base 220. It should be noted that although the coupling members 218 and the receiving apertures 222 are shown to be circular, other polygonal or non-polygonal shapes are contemplated for the coupling members 218 and/or receiving apertures 222.

As shown in FIG. 2B, after the mechanical cover 224 is coupled to the base 220, the trim cover 226 is placed on top of the mechanical cover 224 to further assemble the circuit breaker 200. The trim cover 226 desirably includes trim cover apertures 228 which are positioned to align with the through-channels 219 of the coupling members 218 of the cover supports 202. In particular, once the trim cover 226 is properly placed on top of the mechanical cover 224, the trim cover apertures 228 will be aligned with the through-channels 219. Once the screws 99 are inserted through the trim cover apertures 228, the screws will be received in the threaded through-channels 219. The through-channels 219 will engage the screws 99 and as the screws 99 are tightened, the trim cover 226, the mechanical cover 224 and the base 220 will be tightly secured to one another. In other words, the positioning of the coupling members 218 of the cover supports 202 within the receiving apertures 222 of the mechanical cover 224 along with the use of screws 99 to hold the trim cover 226, the mechanical cover 224 and base 220 together will provide the added support and mechanical stability to allow the circuit breaker 200 to withstand any forces from interruption gases within the circuit breaker 200. It should also be noted that although only two cover supports are shown and described, more than two or only one cover support can be incorporated in the circuit breaker.

Figure 3:
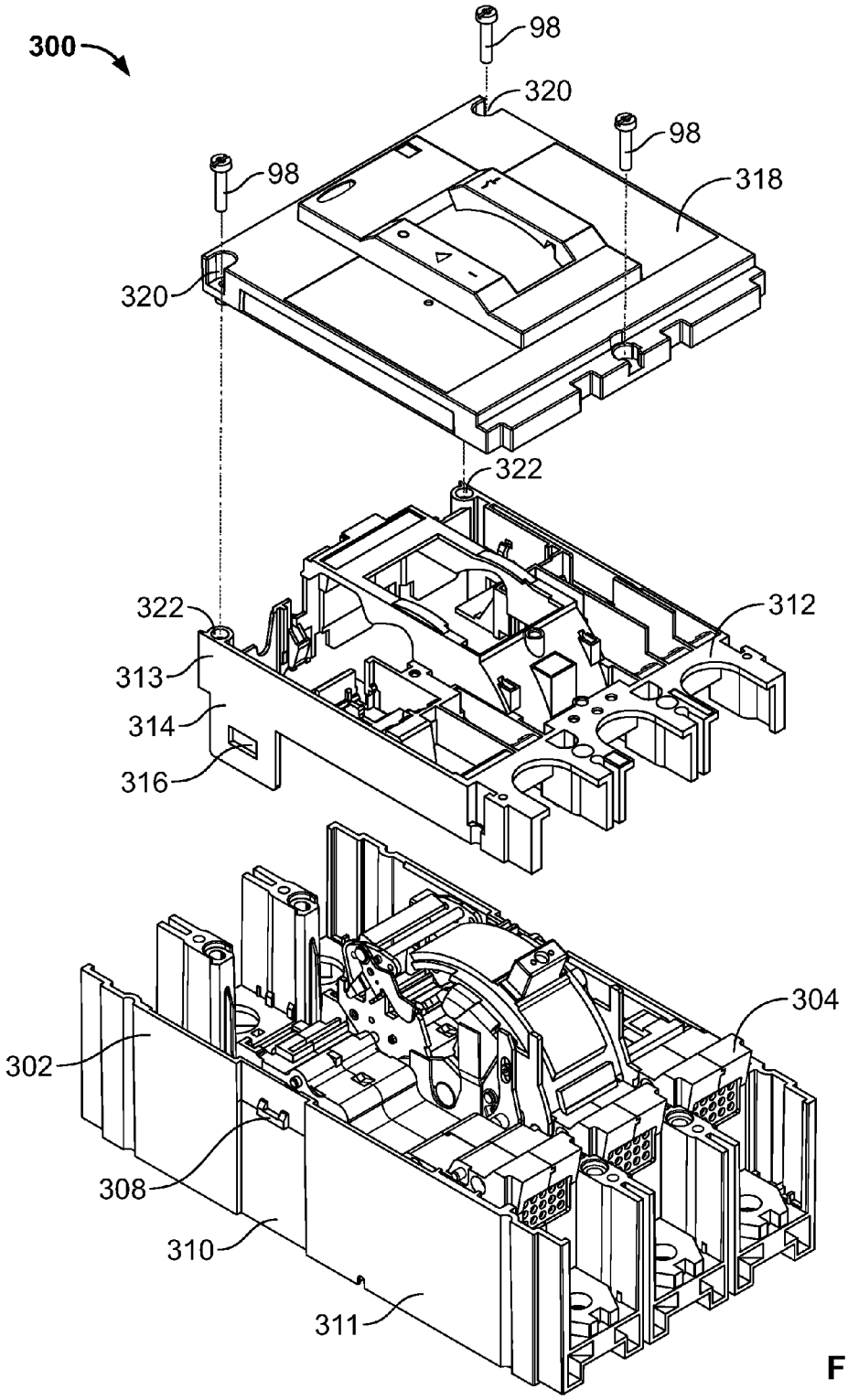
FIG. 3 illustrates an exploded view of a portion of a circuit breaker with snap fit configuration in accordance with one or more aspects of the present disclosure.

FIG. 3 illustrates an exploded view of a circuit breaker in accordance with an aspect of the present disclosure. The circuit breaker 300 shown in FIG. 3 includes a snap fit configuration that further mechanically secures the base 302 and the mechanical cover 312 when the mechanical cover 312 is coupled to the base 302. In particular, the base 302, which is shown housing the ampoule assembly 304 includes one or more boss features 308 protruding from an optional notched area 310 on the side surface 311. Additionally, the mechanical cover 312 includes a flange 314 extending vertically downward from its side surface 313, wherein the flange 314 is positioned to fit within the notched area 310 when the mechanical cover 312 is coupled to the base 302, as shown in FIG. 3. The flange 314 desirably includes one or more apertures 316 which are dimensioned to receive the one or more boss features 308 and correspondingly interlock with the one or more boss features 308 to secure the mechanical cover 312 to the base 302. It is contemplated that the thickness of the flange 314 is substantially similar to the depth dimension of the notch 310 to ensure that the flange 314 is flush with the remaining side of the base 302 when the mechanical cover 312 is coupled to the base 302. It should also be noted that although only one flange and boss assembly is shown in FIG. 3, more than one flange and notch assembly be incorporated on only one side or both sides of the circuit breaker.

It is desired that the flange 314 is molded with the mechanical cover 312 and is therefore integral with the cover 312. Additionally, it is desired that the boss 308 is molded with the base 302 and is therefore integral with the base 302. Although not necessary, an adhesive or other securing means can be applied between the flange 314 and the boss 308 to further secure the mechanical cover 312 to the base 302. It should be noted that the mechanical cover 312 and the base 302 can be designed such that the cover 312 includes the boss and the base includes the flange.

As shown in FIG. 3, the trim cover 318 is placed on top of the mechanical cover 312 to further assemble the circuit breaker 300. The trim cover 318 includes trim cover apertures 320 which are positioned to align with the receiving apertures 322 of the mechanical cover 312 (FIG. 3). Once the trim cover 318 is properly placed on top of the mechanical cover 312 and the trim cover apertures 320 are aligned with the receiving apertures 322, screws 98 are inserted into the trim cover apertures 320 and tightened to secure the trim cover 318 and the mechanical cover 312 together. Additionally, the snap fit configuration between the mechanical cover 312 and the base 302 will provide added support and mechanical stability to allow the circuit breaker 300 to withstand any forces from interruption gases within the circuit breaker 300.

Figure 4A:
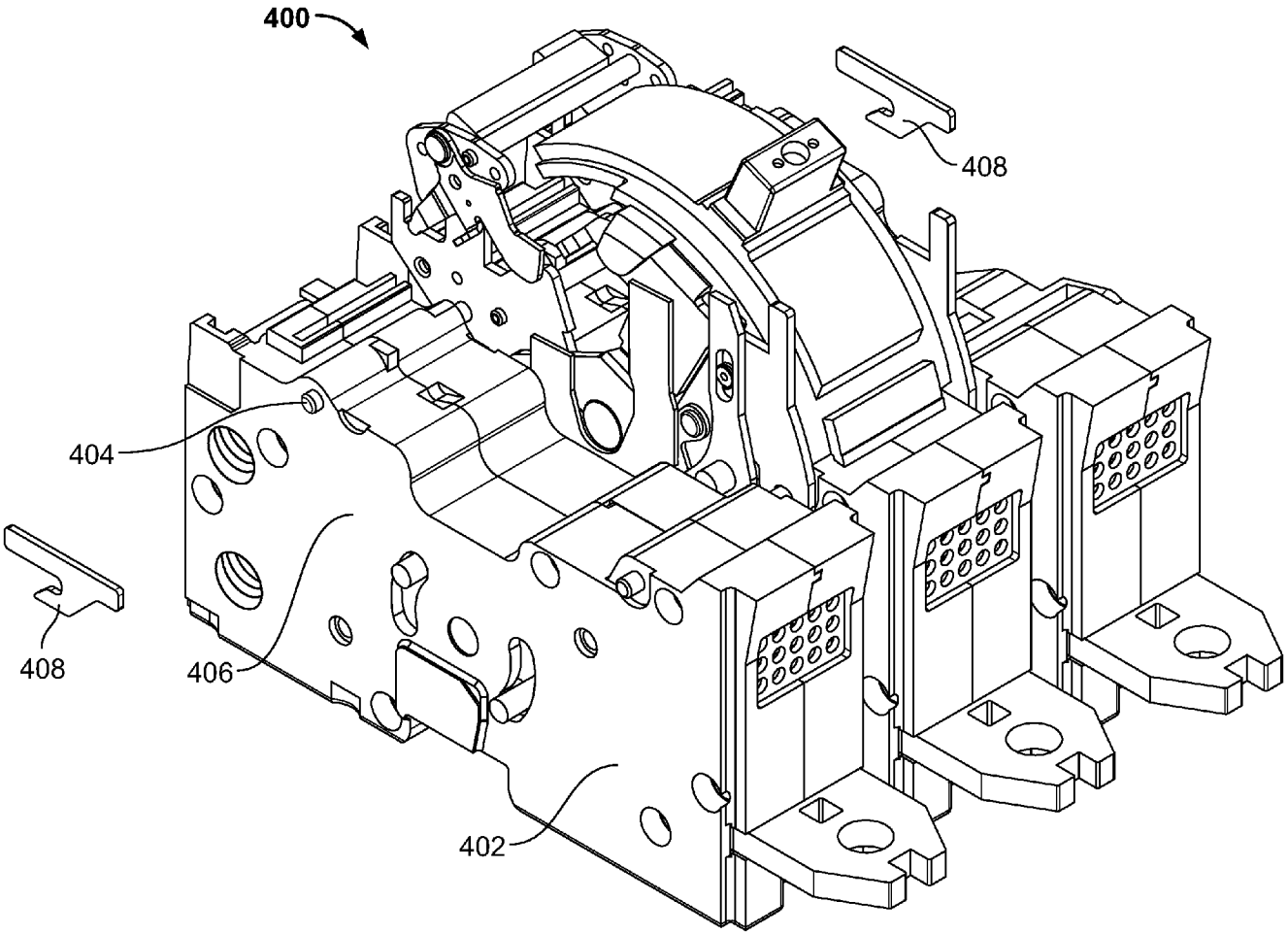
FIG. 4A illustrates an exploded view of an ampoule assembly and a retainer clip in accordance with one or more aspects of the present disclosure.
Figure 4B:
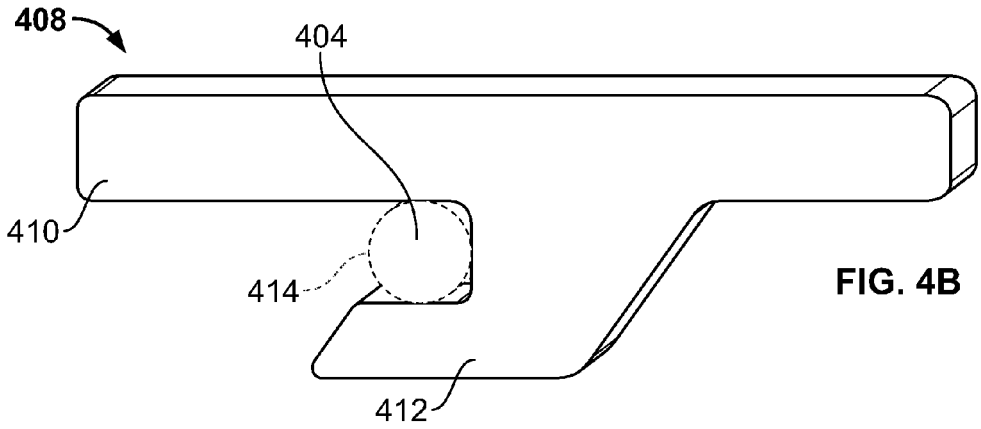
FIG. 4B illustrates a side view of the retainer clip in accordance with one or more aspects of the present disclosure.

FIG. 4A illustrates a partially exploded view of the circuit breaker in accordance with an aspect of the present disclosure. As shown in FIG. 4A, the ampoule assembly 402 includes one or more ampoule pins 404 that partially protrude outward from the side surface 406 of the ampoule assembly 402. In addition, the circuit breaker 400 includes a retainer clip 408 which is configured to fit at least partially around and thus engage the ampoule pin 404. In particular, as shown in FIG. 4B, the retainer clip 408 is desirably a thin metal or steel component. The retainer clip 408 has an "h-shape" and includes a horizontally oriented upper portion 410. The retainer clip 408 includes an integral "L-shaped" lower portion 412 which extends vertically downward from the upper portion 410 and then extends horizontally to be substantially parallel to the horizontal upper portion 410. Between the upper and lower portion is a notch 414 that has a dimension corresponding to the diameter of the ampoule pin 404. As shown in FIG. 4B, the ampoule pin 404 (shown in phantom lines) snugly fits within the notch 414 when the retainer clip 408 is coupled to the ampoule assembly 402.

Figure 4C:
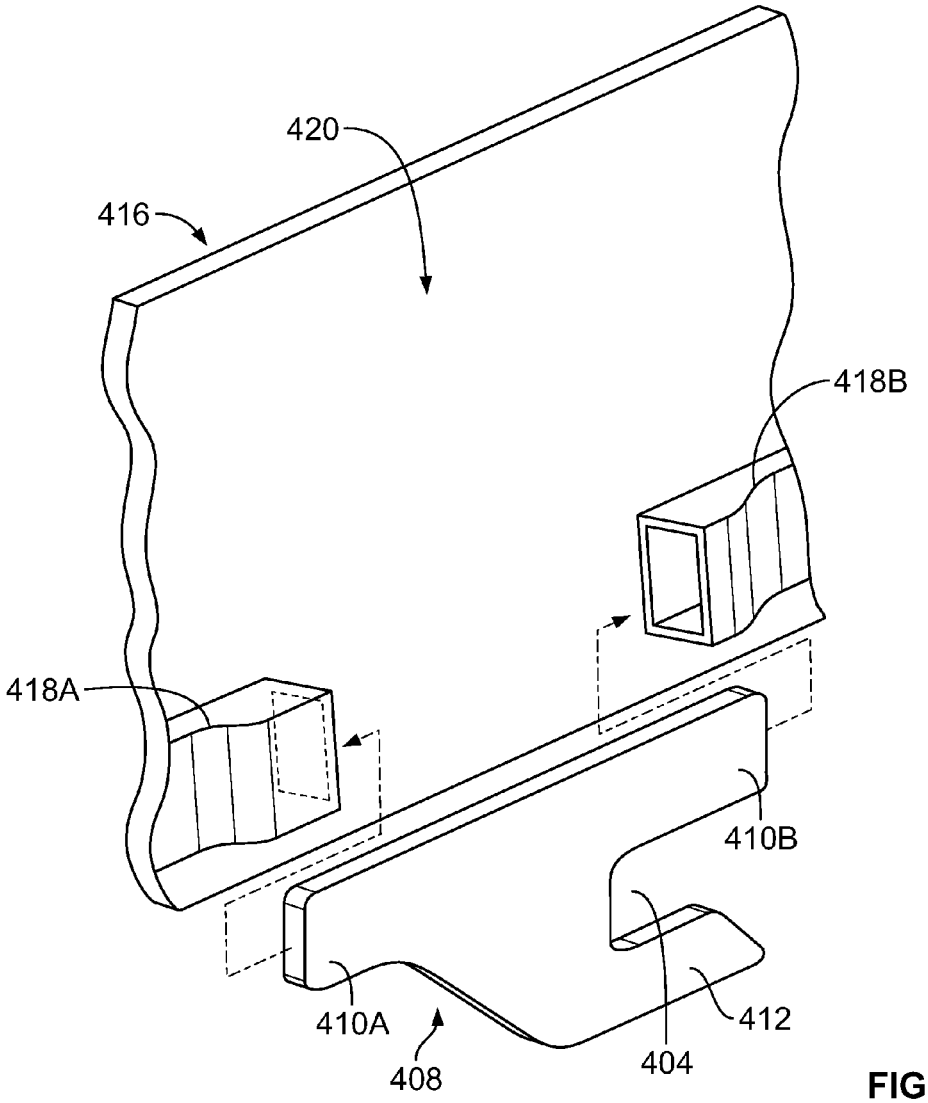
FIG. 4C illustrates a perspective view of the retainer clip and a mechanical cover in accordance with one or more aspects of the present disclosure.

As shown in FIG. 4C, the mechanical cover 416 can include integrally molded retaining grooves 418A, 418B located on its interior surface 420, wherein the retaining grooves 418A, 418B are configured to receive corresponding upper portions 410A and 410B of the retainer clip 408. In this aspect, once inserted into the grooves 418A and 418B, the retainer clip 408 will be mechanically mounted to the mechanical cover 416. It should be noted that the grooves 418A and 418*b* are only an example, and that the mechanical cover 416 may have alternative features which allow the retainer clip 408 to be mounted to the mechanical cover 416. In one aspect, it is contemplated that the mechanical cover 416 not have any mechanical features, whereby the retainer clip 408 is simply mounted to the cover 416 may applying an adhesive between the upper portion 418 of the clip 408 and the inner surface 420 of the cover 416. In any event, upon the upper portion of the clip 408 being coupled to the mechanical cover 416, and the lower portion being coupled to the ampoule pin 404, the use of the retainer clip 408 will provide added support and mechanical stability to hold the mechanical cover 416 to the ampoule assembly 402 and thus allow the circuit breaker 400 to withstand any forces from interruption gases within the circuit breaker 400.

As with the above description, a trim cover is placed on top of the mechanical cover to further assemble the circuit breaker 400. The trim cover desirably includes trim cover apertures which are positioned to align with the receiving apertures of the mechanical cover. In particular, once the trim cover is properly placed on top of the mechanical cover, the trim cover apertures will be aligned with the receiving aperture. Once the screws are inserted through the trim cover apertures, the screws will be received in the receiving apertures, whereby tightening of the screws will hold the trim cover, the mechanical cover and base together and provide the added support and mechanical stability to allow the circuit breaker to withstand any forces from interruption gases within the circuit breaker.

It should be noted that although three features are described above which can be utilized to increase mechanical support to the circuit breaker to allow it to withstand forces from interruption gases that form within the circuit breaker, it is contemplated that the circuit breaker may use more than one of the above features (including possibly all three features) in combination to accomplish this goal.

While particular aspects and applications of the present disclosure have been illustrated and described, it is to be understood that the present disclosure is not limited to the precise construction and compositions disclosed herein and that various modifications, changes, and variations may be apparent from the foregoing descriptions without departing from the spirit and scope of the present disclosure as defined in the appended claims.

What is claimed is:

1. A circuit breaker comprising:

a base;

an ampoule assembly having a switch, the ampoule assembly positioned within the base;

a cover support coupled to a side of the ampoule assembly and positioned between the ampoule assembly and the base, the cover support including a cylindrical coupling member having a through-channel;

a mechanical cover coupled to the base and positioned on top of the ampoule assembly, the mechanical cover including a receiving aperture aligned with the coupling member, wherein the coupling member is inserted into the receiving aperture; and a screw inserted into the through-channel to secure the mechanical cover to the base via the cover support and prevent damage to the mechanical cover from interruption gases within the circuit breaker.

2. The circuit breaker of claim 1, further comprising a trim cover including a trim cover aperture positioned to align with the through-channel and the receiving aperture, wherein the screw secures the trim cover to the mechanical cover and the base.

3. The circuit breaker of claim 1, wherein the cover support includes a protrusion extending from the cover support perpendicularly to a long axis of the through channel, wherein the protrusion fits within a side aperture of the ampoule assembly to couple the cover support to the ampoule assembly.

4. The circuit breaker of claim 1, wherein the cover support is secured to the ampoule assembly by an attachment means.

5. The circuit breaker of claim 4, wherein the attachment means is an adhesive.

6. The circuit breaker of claim 1, wherein the cover support includes a vertically oriented stabilizing protrusion configured to fit within a mating feature of the mechanical cover.

7. A circuit breaker comprising:

a base, the base having a first interlocking feature on a side surface of the base;

an ampoule assembly having a switch, the ampoule assembly positioned within the base;

a mechanical cover coupled to the base and positioned on top of the ampoule assembly, the mechanical cover including a second interlocking feature on a side surface of the mechanical cover, wherein the second interlocking feature locks with the first interlocking feature via a snap fit configuration to secure the mechanical cover to the base and prevent damage to the mechanical cover from interruption gases within the circuit breaker.

8. The circuit breaker of claim 7, wherein the first interlocking feature further comprises at least one boss protruding from the side surface of the base.

9. The circuit breaker of claim 8, wherein the second interlocking feature further comprises a flange including at least one corresponding aperture dimensioned to receive the at least one boss therein.

10. The circuit breaker of claim 9, wherein the base further comprises an indented portion in the side surface of the base where the at least one boss is located, the indented portion having a depth dimension substantially similar to a thickness dimension of the flange.

11. The circuit breaker of claim 9, wherein the flange is integrally molded with the mechanical cover.

12. The circuit breaker of claim 7, further comprising:

a trim cover including a trim cover aperture positioned to align with a receiving aperture of the mechanical cover; and a screw inserted through the trim cover aperture and the receiving aperture to secure the trim cover to the mechanical cover and the base.

13. A circuit breaker comprising:

a base;

an ampoule assembly having a switch, the ampoule assembly positioned within the base and having an ampoule pin extending from a side of the ampoule assembly;

a mechanical cover positioned on top of the ampoule assembly; and a retainer clip having an upper portion and a lower portion and a notch defined between the upper portion and the lower portion, wherein the upper portion is mounted to the mechanical cover and the notch engages the ampoule pin to secure the mechanical cover to the base and prevent damage to the mechanical cover from interruption gases within the circuit breaker.

14. The circuit breaker of claim 13, wherein the mechanical cover further comprises at least one receiving groove on an inner surface, wherein the at least one receiving groove is configured to receive an end of the upper portion therein to mount the retainer clip to the mechanical cover.

15. The circuit breaker of claim 13, wherein the retainer clip is mounted to the mechanical cover via an adhesive.

16. The circuit breaker of claim 13, wherein the lower portion of the retainer clip is substantially parallel to the upper portion, at least a portion of the lower portion configured to be vertically below the upper portion.

17. The circuit breaker of claim 13, further comprising:

a trim cover including a trim cover aperture positioned to align with a receiving aperture of the mechanical cover; and a screw inserted through the trim cover aperture and the receiving aperture to secure the trim cover to the mechanical cover and the base.

* * * * *